United States Patent [19]

Chen et al.

[11] Patent Number: 4,952,277

[45] Date of Patent: Aug. 28, 1990

[54] PROCESS FOR PRODUCING KRAFT PULP FOR PAPER USING NONIONIC SURFACE ACTIVE AGENTS TO IMPROVE PULP YIELD

[75] Inventors: Cheng-I Chen, Jacksonville; Theresa D. Hancock, Green Cove Spring, both of Fla.

[73] Assignee: Bet PaperChem, Inc., Jacksonville, Fla.

[21] Appl. No.: 354,982

[22] Filed: May 19, 1989

Related U.S. Application Data

[63] Continuation-in-part of Ser. No. 163,043, Mar. 2, 1988, abandoned.

[51] Int. Cl.[5] ..... D21C 3/02; D21C 3/20

[52] U.S. Cl. ..... 162/72; 162/82; 162/DIG. 3

[58] Field of Search ..... 162/72, 82, DIG. 3

[56] References Cited

U.S. PATENT DOCUMENTS

| | | | |
|---|---|---|---|
| 2,716,058 | 8/1955 | Rapson | 162/72 |
| 2,999,045 | 9/1961 | Mitchell | 162/72 |
| 3,909,345 | 9/1975 | Parker | 162/72 |
| 4,426,254 | 1/1984 | Weed | 162/DIG. 3 |
| 4,483,741 | 11/1984 | Maloney | 162/72 |

FOREIGN PATENT DOCUMENTS 1140706 6/1979 Canada .

OTHER PUBLICATIONS

Compos et al., "Kraft Pulping is Improved . . . ", Pulp Paper Intern., 15, No. 11 (Oct. 1973), 49–52 (abstract).
D. J. M. Wenzl, "Fatty Acid Diethylamide . . . " ∝ (abstract), Allg. Papier-Rundschau, No. 18 (5/5/75), 476, 478, 480, 485–486.
Chem. Abstracts 66: 96381m (1967).
Chemical Abstracts 104: 151142q (1986).
Chemical Abstracts 102: 205630b (1985).
Chemical Abstracts 101: 173305k (1984).
Chem. Abstracts 98: 128003u (1983).
Chem. Abstracts 102: 168566n (1985).
Chem. Abstracts 91: 159228f (1979).
Chemical Abstracts 94: 105141r (1981).
Chemical Abstracts 93: 27998p (1980).
Chemical Abstracts 92: 95832j (1980).
Chemical Abstracts 90: 170394g (1979).
Chemical Abstracts 90: 123364n (1979).
Chemical Abstracts 90: 40427j (1979).
G. Bone, Undergraduate Thesis Miami University (Ohio), May, 1977.
Chemical Abstracts 73: 67828b.
Chemical Abstracts 94: 17330w (1981).
Chemical Abstracts 82: 158027s.
Chemical Abstracts 87: 25028z (1977).
Chemical Abstracts 86: 157305b (1977).
Chemical Abstracts 82: 60225e.
Chemical Abstracts 91: 22669f (1979).
Chemical Abstracts 89: 148366g (1978).
Chemical Abstracts 88: 52165u (1978).
Chemical Abstracts 100: 141044n (1984).
Chemical Abstracts 96: 183008h (1982).
K. E. Lowe et al., *Paper Trade Journal*, Sep. 29, 1969.
Wood Chips-Production, Handling, Transport (Snd ed., Rome, 1976), FAO, pp. 77–80.
F. Keith Hall, "Wood Pulp", *Scientific American* (Apr. 1974), pp. 52–62.

*Primary Examiner*—Steve Alvo
*Attorney, Agent, or Firm*—Alexander D. Ricci; Alex R. Sluzas

[57] ABSTRACT

A process for making paper and linerboard, employing certain nonionic surface active agents to increase the yield of kraft pulping. The surface active agents having the structural formula

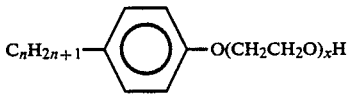

where n is an integer from 8 to 12, and x is a positive integer from 1 to about 100, the surface active agent being present in the cooking liquor in an amount effective to increase the yield of pulp.

9 Claims, No Drawings

PROCESS FOR PRODUCING KRAFT PULP FOR PAPER USING NONIONIC SURFACE ACTIVE AGENTS TO IMPROVE PULP YIELD

This application is a continuation-in-part of copending U.S. patent application Ser. No. 163,043 filed March 2, 1988, and now abandoned.

BACKGROUND OF THE INVENTION

1. Field Of The Invention

The present invention relates generally to a process for making paper, and more particularly to the production of wood pulp by the sulfate pulping process for subsequent use in making paper and linerboard.

2. Brief Description Of The Prior Art

In the kraft or sulfate process for making wood pulp carefully dimensioned wood chips are subjected to alkaline reagents (including sulfide ion) at elevated temperature and pressure in a digester. The reaction conditions are carefully chosen to selectively hydrolyze lignin, the amorphous polymeric binder of the wood fibers. The wood fibers are principally composed of cellulose. However, each of the three major constituents of wood, lignin, cellulose and hemicellulose is subject to alkaline hydrolysis and degradation. In carrying out the pulping process, it is desirable to maximize the yield defined as dry weight of pulp per unit dry weight of wood consumed.

Although efforts are usually made to provide wood chips which shape, there are often variations in the size and shape of the wood chips and in the structure and composition of the woods chips themselves. Ideally, the digestion of the wood chips is carried only long enough to dissolve sufficient lignin to free each wood fiber. At this point the digester charge is "blown" into a receiving vessel or blow tank. The sudden drop in pressure serves to mechanically break up the wood chips from which the lignin has been removed. For some paper making applications, it is desirable to subsequently remove the residual lignin, as the lignin confers the characteristic brown color of kraft paper. However, when the object is to produce linerboard or kraft paper it is generally desirable to produce the highest possible yield of wood pulp, although this implies that, in addition to the cellulosic fibers, the pulp will also include non-cellulosic constituents, such as lignin, hemicellulose, natural resins, and other wood constitutents.

While ideally each of the wood chips is completely separated when the digester is blown into the blow tank into separate wood fibers, in practice a fraction of the wood chips fails to separate or only incompletely separates when the digester is blown. These materials are removed from the wood pulp by passing the pulp through a screen having openings of a predetermined size. The materials that are recovered are known as "rejects" in the pulping art. As the rejects include wood fibers, they represent a reduction from the yield of pulp which is ideally achievable. However, the potential yield which these rejects represent cannot be realized simply by lengthening the period of digestion or increasing the severity of the digestion conditions. Although the proportion of rejects would no doubt decline, so also would the total yield because the increased digestion time or more severe hydrolysis conditions would attack not only the lignin in the rejects, but also the cellulose in chips from which the lignin had already been removed.

The digestion of wood chips is a complex process. The chips themselves are highly structured and nonhomogeneous. The rate of degradation and removal of amorphous lignin from the chips is believed to be limited by the rate of diffusion of lignin hydrolysis products from the chips. However, this model of the delignification process does not provide insight regarding how to increase its rate. Means to improve the yield in the sulfate pulping process appear to have been found emperically. For example, U.S. Pat. No. 3,909,345, incorporated herein by reference, discloses the use of surface active agents or surfactants having the general formula $$R[(C_2H_4O)_m(C_3H_{60})_n]yH$$

as additives to the sulphate cooking liquor for the purpose of obtaining higher yields of pulp from a given wood chip charge. Chemical Abstracts 94:105141r (W. Surewicz et al, *Przegl. Papier.* (1980) 36(8)291-4) discloses addition of ethoxylated amines to cooking liquor to increase kraft pulp yield. Chemical Abstracts 104: 1511429 (British Pat. 2,155,966) discloses the addition of an amphoteric surface active agent to aid in the penetration of chemicals into the wood structure and dissolution of the lignin with not more than normal carbohydrate degradation and in a much shorter cooking cycle. The amphoteric surface active agent can be an amidated or quaternized poly(propylene glycol) carboxylate. While some types of surface active agents are disclosed in the art to be useful in increasing penetration of the cooking liquor into wood chips et al., in general, because the process of pulping chips is highly complex and unpredictable, it is not possible to predict whether a particular class of surface active agents will be useful.

The use of nonionic surface active agent in processes for treating wood pulp after the pulp has been prepared by digestion of wood chips is also known. For example, U.S. Pat. Nos. 2,716,058, 2,999,045 and 4,426,254 each relate to the extraction of natural resins from wood pulp. Effective separation of natural resins from the pulp is necessary for the production of purified cellulose as is used in the manufacture of cellophane, viscose rayon, cellulose nitrate, cellulose acetate and like. Of course, use of such surface active agents to solubilize resin would tend to reduce, rather than increase the yield of pulp. Consequently the art which discloses the use of nonionic surface active agents to deresinate wood pulp implicitly cautions against the use of such materials in attempting to increase pulp yield.

There is a continuing need to improve wood pulping processes in general, and kraft pulping processes for the production of linerboard and paper products in particular. Although wood itself is a renewable resource, the continuously increasing demand for linerboard and paper products requires that the most efficient use possible be made of wood as a raw material. Because the kraft pulping of wood chips for linerboard and paper products is carried on such a large industrial scale, processing improvements which yield even small increases in efficiency can have substantial economic and environmental impact.

SUMMARY OF THE INVENTION

The present invention provides a process for making paper and linerboard and employs the kraft or sulfate process for making pulp from wood chips. The process comprises cooking the wood surface active agent, or surfactant, having the general formula

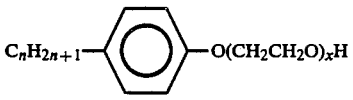

where n is an integer from 8 to 12, and x is an integer from 1 to about 100. The surface active agent is present in the cooking liquor in an amount effective to increase the yield of pulp obtained from the wood chips. Preferably, the surface active agent is added in an amount from about 0.0005 to 1% of the dry weight of the wood chips, more preferably in an amount from about 0.01 to 0.05%, and adding the surface active agent in an amount from about 0.05 to 0.05% by dry weight of the wood chips is especially preferred.

The surface active agents can be used together with other surface active agents or additives, such as anthaquinone, to improve pulp yield in the present process, or they can be used in the absence of other surface active agents or additives. In particular, the surface active agents of the present invention can be used in the absence of anthaquinone; anthaquinone can be excluded from the cooking liquor.

In general, the liquor in which the wood chips are cooked, or cooking liquor, comprises a mixture of black and white liquor, the black liquor being liquor resulting from cooking a prior batch of wood chips and the white liquor being a freshly prepared alkaline solution. Preferably, the surface active agent is added to the black liquor before the black liquor is mixed with the white liquor. However, the surface active agent can also be added to a mixture of the white liquor and the black liquor, or it can be used in treating the wood chips prior to contacting the wood chips with the cooking liquor.

The process of the present invention provides a surprising unexpected increase in the yield of wood pulp obtained from digestion. The increase in weight of wood pulp obtained is accompanied by a corresponding decrease in the portion of rejects screened from the pulp after the digester charge is blown. Thus the process provides an improved method for making wood pulp for use in paper and linerboard production.

DETAILED DESCRIPTION OF THE PREFERRED EMBODIMENTS

In chemical pulping, the cooking of wood chips is usually terminated when the amounts of rejects in the wood pulp is reduced to an acceptable level. However, substantial yield improvements can be obtained when chips are cooked to a higher kappa number and lignin content. As result, an increase in the target kappa number through the use of thinner chips to minimize rejects can achieve a substantial cost savings. However, the thickness of chips produced on commercial equipment is always quite variable, and a major portion of the total rejects frequently originate from a relatively small fraction of the chips having the greatest thickness.

The sulfate or kraft process can be used to pulp wood chips obtained from a great variety of deciduous and coniferous trees. For example, wood chips obtained from various species of pine, spruce, fir, cedar, maple, oak, poplar, and the like can be pulped by the kraft process.

While not being bound to a specific theory or explanation regarding the observed improvement in yield obtainable with the process of the present invention, it is believed that the addition of the surface active agent employed in the present invention to the cooking liquor enhances either the penetration of the cooking liquor into the wood chips, the diffusion of lignin degradation products from the wood chips, or both. In any case the addition of the surface active agents to the cooking liquor results in fewer rejects and an increase pulp yield.

The surface active agents employed in the present invention are nonionic surfactants well known in the chemical arts in general. These surface active agents are known for a number of specific applications such as emulsifiers, wetting agents, detergents, penetrants, solublilizing agents, and dispersents in detergent, textile, agricultural, metal cleaning, petroleum, cosmetic, paint, cutting oil, and janitorial supply products. Some of the surface active agents have been employed as paper rewetting agents for use in producing high wet strength paper towels and tissues and corrugating media. Given that these surface active agents have long been available commercially and are well known in general in the chemical art, the advantageously increased pulp yield obtained when the surface active agents are used in the present invention is particularly surprising and unexpected.

An objective of the present invention is to achieve a lower weight ratio of rejects to wood chips and greater yield of wood pulp by the addition of the subject surface active agents to cooking liquor.

Three presently preferred commercially available nonionic surface active agents for use in the process of the present invention are Igepal ® (trademark of GAF Corporation) RC-520 (dodecylphenoxy penta(ethyleneoxy)ethanol, Triton ® (trademark of Rohm and Haas Company) X-100 (octyl phenoxy poly(ethyleneoxy) ethanol having 9–10 ethyleneoxy units), and Surfonic ® (trademark) of Texaco Chemical Company) N-95 (nonylphenoxypoly(ethyleneoxy) ethanol having approximately nine ethyleneoxy units).

The surface active agents of the present invention can be used alone, or as they can be used in conjunction with other surface active agents in the cooking liquor. For example, the surface active agents of the present invention can be used with the various surfactants such as the poly(ethyleneoxy)/(propleneoxy) block copolymers disclosed in U.S. 3,909,345 and/or those disclosed in U.S. patent application Serial No. 065,103 filed June 26, 1987. Similarly, mixtures of the surface active agents of the present invention and amphoteric surface active agents such as disclosed in British Pat. No. 2,155,966 or ethoxylated amines such as disclosed in Chemical Abstracts 94:10514r can be employed.

When the black liquor is separated from the pulp by washing to yield a weak black liquor which is subsequently further processed, as in many kraft liquor recovery systems, the surface active agent of the present invention is preferable added subsequent to any high temperature smelting stage which may be employed in the liquor recovery process, as the high temperatures there encountered are likely to have a deleterious effect on the surface active agent. In addition to use in traditional kraft or sulfate pulping processes, the surface active agents of the present invention can also be used in various modifications of the kraft process, such as in polysulfide processes, processes employing anthraquinone or anthraquinone derivatives such as salts of anthraquinone-2-sulfonate, soda-oxygen processes and soda-anthraquinone processes.

The following examples disclose a process of the present invention to prepare wood pulp under laboratory conditions. Based on the laboratory results, the process of the present invention is believed to be effective in commercial scale (i.e. paper mill scale) pulping of wood chips. It is believed that in general the laboratory scale enhancements in pulp yield are predictive of similar improvements in mill scale processes, in that frequently the increases in yield observed in the mill are the same as or greater than those observed in the laboratory tests.

In the following examples the kraft or sulfate pulping conditions were as follows:

The active alkali employed was 15% by weight as $Na_2O$ unless otherwise noted. The sulfidity of the cooking liquor was 25% by weight. The weight ratio of the cooking liquor to wood chips (dry weight basis) was from 5.6/1 to 7/1. The chip cooking temperature was approximately 170° Celsius. Approximately 90 minutes were required to achieve the cooking temperature and the chips were maintained at the cooking temperature for approximately 36 minutes.

In the laboratory procedure wood chips are first collected from a paper mill source. A sample of the wood chips to be cooked is taken and oven dried to determine the moisture content. The amount of wood chips fed to the cooking vessel or digester is selected to provide a predetermined weight ratio of chips (dry weight) to cooking liquor. A laboratory scale digester, equipped with temperature and pressure monitoring devices and having a capacity of 6 liters is charged with the wood chips, alkali cooking liquor and optional surface active agent additive. The digester is heated by electricity until the target cooking temperature is achieved. The wood chips are cooked with the liquor at the temperature indicated in the closed digester. After the cook is completed the pressure in the digester is released. A sample of the chips is rinsed to remove residual alkali, and the rinsed chips are allowed to drain for one hour. The chips are mechanically agitated in a laboratory blender to simulate the process of blowing the charge of the digester into a blow tank as practiced on a mill scale. The cook pulp is then screened using a seive (26/1000 inch seive size screen) and the percentage rejects is determined. The rejects are the material retained on the screen. The rejects percentage is determined by drying the material retained on the screen and utilizing that weight in conjunction with the dry weight of chips added to establish the weight percentage of material rejected. The screened yield is determined in like fashion.

In the following laboratory studies pulping trials were conducted using surface active agents of the present invention. For control purposes, a comparative trial was carried out using chips from the same batch as that used in the trial according to this invention in order to help compensate for chip variability. Using the pulping parameters mentioned above, Examples 1–13 and corresponding Comparative Examples 1–13 were carried out. The results of the trials are reported in Table I.

TABLE I

| Example or Comparative Example | Surface Active Agent | Dosage[4] Level (%) | Screen[5] Yield (%) | Reject[6] Level (%) |
|---|---|---|---|---|
| Example 1 | Surfonic ® N-95[1] | 0.05 | 43.9 | 13.7 |
| Comp. Ex. 1 | None | — | 39.4 | 18.6 |
| Example 2 | Triton ® X-100[2] | 0.075 | 51.5 | 3.6 |
| Comp. Ex. 2 | None | — | 47.3 | 8.0 |
| Example 3 | Igepal ® RC-520[3] | 0.075 | 47.2 | 7.7 |
| Comp. Ex. 3 | None | — | 43.9 | 11.6 |
| Example 4 | Surfonic ® N-95[1] | 0.05 | 44.65 | 11.92 |
| Comp. Ex. 4 | None | — | 42.53 | 16.23 |
| Example 5 | Surfonic ® N-95[1] | 0.05 | 43.26 | 14.37 |
| Comp. Ex. 5 | None | — | 36.76 | 22.19 |
| Example 6 | Surfonic ® N-95[1] | 0.05 | 41.48 | 17.45 |
| Comp. Ex. 6 | None | — | 39.44 | 20.75 |
| Example 7 | Surfonic ® N-95[1] | 0.05 | 44.72 | 11.25 |
| Comp. Ex. 7 | None | — | 43.81 | 11.01 |
| Example 8 | Surfonic ® N-95[1] | 0.05 | 44.65 | 12.19 |
| Comp. Ex. 8 | None | — | 37.50 | 20.29 |
| Example 9 | Surfonic ® N-95[1] | 0.05 | 45.21 | 12.57 |
| Comp. Ex. 9 | None | — | 40.64 | 13.55 |
| Example 10 | Surfonic ® N-95[1] | 0.05 | 43.66 | 14.64 |
| Comp. Ex. 10 | None | — | 46.27 | 9.80[7] |
| Ave. (Ex. 4–10) | | | 43.9 | 13.7 |
| Ave. (Comp. Ex. 4–10) | | | 39.4 | 18.6 |
| Example 11 | Surfonic ® N-95[1] | 0.05 | 38.61 | 22.52 |
| Comp. Ex. 11 | None | — | 34.17 | 28.70 |
| Example 12 | Surfonic ® N-95[1] | 0.05 | 38.03 | 19.11 |
| Comp. Ex. 12 | None | — | 36.53 | 24.95 |
| Example 13 | Surfonic ® N-95[1] | 0.05 | 38.27 | 22.44 |
| Comp. Ex. 13 | None | — | 34.50 | 30.28 |
| Ave. (Ex 11–13) | | | 38.30 | 21.36 |
| Ave. (Comp. Ex. | | | 35.07 | 27.98 |

TABLE I-continued

| Example or Comparative Example | Surface Active Agent | Dosage[4] Level (%) | Screen[5] Yield (%) | Reject[6] Level (%) |
|---|---|---|---|---|
| 11–13) | | | | |

[1]Surfonic ® (trademark of Texaco Chemical Company) N-95 (nonylphenoxypoly(ethyleneoxy)ethanol having approximately nine ethyleneoxy units).
[2]Triton ® (trademark of Rohm and Haas Company) X-100 (octyl phenoxy poly(ethyleneoxy)ethanol having 9–10 ethyleneoxy units).
[3]Igepal ® (trademark of GAF Corporation) RC-520 (dodecylphenoxy penta(ethyleneoxy)ethanol.
[4]Weight percent on wood chips solids.
[5]Weight percent on wood chips solids.
[6]Weight percent on wood chips solids.
[7]Disregarded in computing average because fungal growth on chips was noted.

The results reported in Table I show that the process of the present invention provides an unexpected increase in the proportion of screened yield obtained in pulping process and the corresponding and a surprising unexpected reduction in the proportion of rejects screened from the pulp.

The effect of varying the active akali level on the increase in screen yield and reduction in the reject level obtained when Surfonic N-95 is used in the process was examined, the results being given in Table II. The differences in screen yield and reject level observed in Examples 16 and 17 and Comparative Examples 16 and 17 are attributed to wood chip variability.

TABLE II

| Example or Comparative Example | Active[1] Alkali | Screen[2] Yield (%) | Reject[3] Level (%) |
|---|---|---|---|
| Example 14[4] | 15 | 39.24 | 23.60 |
| Comp. Ex. 14 | 15 | 32.81 | 26.96 |
| Example 15[4] | 20 | 49.49 | 2.71 |
| Comp. Ex. 15 | 20 | 48.63 | 2.85 |
| Example 16[4] | 17.5 | 49.50 | 6.91 |
| Comp. Ex. 16 | 17.5 | 51.68 | 6.47 |
| Example 17[4] | 17.5 | 46.78 | 11.62 |

TABLE II-continued

| Example or Comparative Example | Active[1] Alkali | Screen[2] Yield (%) | Reject[3] Level (%) |
|---|---|---|---|
| Comp. Ex. 17 | 17.5 | 41.11 | 17.60 |

[1]Expressed as $Na_2O$.
[2]Weight percent on wood chip solids.
[3]Weight percent on wood chip solids.
[4]Surfonic ® N-95 - 0.05% weight/weight on wood chip solids.

The effect of using the surface active agents of the present process in conjunction with other materials believed to improve the kraft pulping process was also investigated.

The effect of adding anthraquinone to the cooking liquor in addition to Surfonic N-95 surface active agent was examined, the results being given in Table III. Comparison of the average screen yield and the reject level for Examples 18A-21A (Surfonic N-95 only) with Comparative Examples 18D-21D (no additive) show little difference, apparently reflecting chip variability. However, the combination of anthraquinone and Surfonic N-95 appears to provide significant improvement in screen yield. The improvement is apparent at both levels of anthraquinone examined (0.025%—Examples 18–21 and 0.05%—Examples 22 and 23).

TABLE III

| Example or Comparative Example | Anthraquinone[1] | Surfonic ® N-95[2] | Screen[3] Yield (%) | Reject[4] Level |
|---|---|---|---|---|
| Example 18A | No | Yes | 44.24 | 27.35 |
| Example 18B | Yes | Yes | 46.22 | 17.85 |
| Comp. Ex. 18C | Yes | No | 48.90 | 18.34 |
| Comp. Ex. 18D | No | No | 43.77 | 23.10 |
| Example 19A | No | Yes | 45.74 | 19.41 |
| Example 19B | Yes | Yes | 47.56 | 16.10 |
| Comp. Ex. 19C | Yes | No | 42.96 | 17.68 |
| Comp. Ex. 19D | No | No | 43.10 | 14.86 |
| Example 20A | No | Yes | 42.60 | 15.64 |
| Example 20B | Yes | Yes | 42.53 | 12.64 |
| Comp. Ex. 20C | Yes | No | 42.55 | 14.60 |
| Comp. Ex. 20D | No | No | 43.10 | 14.86 |
| Example 21A | No | Yes | 39.98 | 21.77 |
| Example 21B | Yes | Yes | 46.35 | 8.10 |
| Comp. Ex. 21C | Yes | No | 42.61 | 17.39 |
| Comp. Ex. 21D | No | No | 42.19 | 16.35 |
| Ave (Ex.18A–21A) | No | Yes | 43.14 | 19.87 |
| Ave (Ex.18B–21B) | Yes | Yes | 46.33 | 13.80 |
| Ave (Comp. Ex. 18C–21C) | Yes | No | 43.59 | 16.88 |
| Ave (Comp. Ex. 18D–21D) | No | No | 43.63 | 18.23 |
| Example 22B | Yes[5] | Yes | 47.17 | 11.00 |
| Comp. Ex. 22D | No | No | 42.27 | 13.82 |
| Example 23B | Yes[5] | Yes | 43.79 | 14.40 |
| Comp. Ex. 23D | No | No | 29.15 | 19.85 |
| Ave (Ex.22B and Ex.23B) | Yes[5] | Yes | 45.48 | 12.70 |
| Ave (Comp. Ex. 22D | No | No | 40.71 | 16.59 |

TABLE III-continued

| Example or Comparative Example | Anthraquinone[1] | Surfonic ® N-95[2] | Screen[3] Yield (%) | Reject[4] Level |
|---|---|---|---|---|
| and Comp. Ex. 23D) | | | | |

[1]0.025% w/w on wood chip solids.
[2]0.05% w/w wood chip solids Surfonic N-95.
[3]Weight percent on wood chip solids.
[4]Weight percent on wood chip solids.
[5]0.05% w/w on wood chip solids.

The effect of employing another nonionic surface active agent in addition to the surface active agents of the present invention was also studied in laboratory cooks, some of the results being reported in Table IV. A series of cooks employing a combination of Surfonic N-95 and a one-to-one (by weight) blend of Pluronic ® (trademark of BASF Wyandotte) L-62 and F-108 (block copolymer of polyoxyethylene and polyoxypropylene) were carried out. Comparison of the average screen yield and reject level (Examples 24–33) of the cooks including the two surface active agents with the average for the controls (Comparative Examples 24–33) shows an increase in screen yield and a reduction in the reject level (Table IV).

TABLE IV

| Example or Comparative Example | Surface[1] Active Agent | Screen[2] Yield (%) | Reject[3] Level (%) |
|---|---|---|---|
| Ex. 24 | Yes | 41.95 | 21.30 |
| Comp. Ex. 24 | No | 38.66 | 26.71 |
| Ex. 25 | Yes | 36.75 | 27.59 |
| Comp. Ex. 25 | No | 37.79 | 25.75 |
| Ex. 26 | Yes | 39.63 | 24.07 |
| Comp. Ex. 26 | No | 39.63 | 24.40 |
| Ex. 27 | Yes | 51.11 | 10.82 |
| Comp. Ex. 27 | No | 45.78 | 16.58 |
| Ex. 28 | Yes | 50.82 | 14.42 |
| Comp. Ex. 28 | No | 36.40 | 30.02 |
| Ex. 29 | Yes | 47.32 | 17.63 |
| Comp. Ex. 29 | No | 41.45 | 22.57 |
| Ex. 30 | Yes | 39.77 | 24.36 |
| Comp. Ex. 30 | No | 41.37 | 23.74 |
| Ex. 31 | Yes | 48.33 | 16.56 |
| Comp. Ex. 31 | No | 49.13 | 15.98 |
| Ex. 32 | Yes | 50.05 | 14.94 |
| Comp. Ex. 32 | No | 45.60 | 18.14 |
| Ex. 33 | Yes | 56.39 | 9.80 |
| Comp. Ex. 33 | No | 47.92 | 13.57 |
| Ave (Ex. 24–33) | Yes | 46.16 | 18.17 |
| Ave (Comp. Ex. 24–33) | No | 42.37 | 21.75 |

[1]Yes = 0.025% w/w Surfonic N-95, 0.0125% Pluronic L-62, and 0.0125% Pluronic F-108.
[2]Weight percent on wood chip solids.
[3]Weight percent on wood chip solids.

Other modifications and variations of the process of the present invention will be readily apparent to those skilled in the art, all within the scope of the appended claims.

What is claimed is:

1. A process for making paper or linerboard, the process comprising cooking wood chips in a kraft liquor to form a kraft pulp, the liquor excluding anthaquinone and including a surface active agent having the general formula:

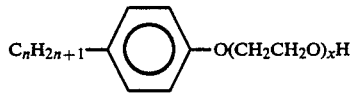

where n is an integer from 8 to 12, and x is a positive integer from 1 to 100, the surface active agent being present in the cooking liquor in an amount effective to increase the yield of pulp.

2. A process according to claim 1 wherein x is a positive integer from 3 to 20.

3. A process according to claim 2 wherein n is 8 and x is a positive integer selected from 9 and 10.

4. A process according to claim 2 wherein n is 9 and x is a positive integer selected from 9 and 10.

5. A process according to claim 2 wherein n is 12 and x is 7.

6. A process according to claim 1 wherein the wood chips are treated with the surface active agent prior to contacting the kraft cooking liquor.

7. A process according to claim 1 wherein the surface active agent is added in an amount from about 0.005 to 1 percent of the dry weight of the wood chips.

8. A process according to claim 7 wherein the surface active agent is added in an amount from about 0.001 to 0.05 percent by weight of the dry weight of the wood chips.

9. A process according to claim 8 wherein the surface active agent is added in an amount from about 0.0065 to 0.02 percent by dry weight of the wood chips.

* * * * *

UNITED STATES PATENT AND TRADEMARK OFFICE

CERTIFICATE OF CORRECTION

PATENT NO. : 4,952,277

DATED : August 28, 1990

INVENTOR(S) : C-I Chen et al

It is certified that error appears in the above-identified patent and that said Letters Patent is hereby corrected as shown below:

On the title page of the patent, at [73], amend the name of the

Assignee to read --Betz PaperChem, Inc--.

Signed and Sealed this

Sixth Day of October, 1992

*Attest:*

DOUGLAS B. COMER

*Attesting Officer*

*Acting Commissioner of Patents and Trademarks*